US006668475B2

(12) United States Patent
Carolan

(10) Patent No.: US 6,668,475 B2
(45) Date of Patent: Dec. 30, 2003

(54) AIR INFLATED PORTABLE BILLBOARD

(76) Inventor: Edward F. Carolan, 1785 N. Sheridan Way, Mississauga, Ontario (CA), L5K 1A2

( * ) Notice: Subject to any disclaimer, the term of this patent is extended or adjusted under 35 U.S.C. 154(b) by 0 days.

(21) Appl. No.: 10/084,165

(22) Filed: Feb. 28, 2002

(65) Prior Publication Data

US 2002/0116849 A1 Aug. 29, 2002

Related U.S. Application Data

(60) Provisional application No. 60/272,068, filed on Mar. 1, 2001.

(30) Foreign Application Priority Data

Feb. 28, 2001 (CA) ..... 2239075

(51) Int. Cl.[7] ..... G09F 15/00
(52) U.S. Cl. ..... 40/610; 40/624
(58) Field of Search ..... 40/610, 624

(56) References Cited

U.S. PATENT DOCUMENTS

| | | | | | |
|---|---|---|---|---|---|
| 3,892,081 | A | | 7/1975 | Goral | |
| 4,179,832 | A | * | 12/1979 | Lemelson | 40/540 |
| 4,271,620 | A | | 6/1981 | Vicino et al. | |
| 4,369,591 | A | * | 1/1983 | Vicino | 40/610 |
| 4,372,071 | A | | 2/1983 | Vicino | |
| 4,416,073 | A | | 11/1983 | Vicino et al. | |
| 4,776,121 | A | | 10/1988 | Vicino | |
| 4,881,916 | A | | 11/1989 | Houser | |
| D306,746 | S | | 3/1990 | Vicino | |
| D334,031 | S | | 3/1993 | Berwert | |
| 5,196,242 | A | | 3/1993 | Vicino | |
| D337,129 | S | | 7/1993 | Sandy | |
| 5,402,591 | A | * | 4/1995 | Lee | 40/610 |
| 5,546,707 | A | * | 8/1996 | Caruso | 52/213 |
| 5,588,236 | A | | 12/1996 | Suzuki | |
| 5,626,814 | A | | 5/1997 | Vicino | |
| 5,680,893 | A | * | 10/1997 | Neer | 160/330 |
| D411,020 | S | * | 6/1999 | Cotton et al. | D25/102 |
| D413,933 | S | | 9/1999 | Glicksman | |
| 6,240,666 | B1 | * | 6/2001 | Apel et al. | 40/610 |

* cited by examiner

*Primary Examiner*—Cassandra H. Davis
(74) *Attorney, Agent, or Firm*—Michael R. Williams; Adrian D. Battison; Ryan W. Dupuis

(57) ABSTRACT

An inflatable billboard has an inflatable frame with an advertising frame mounted onto the frame. The advertising frame is mounted to the frame by both releasable connectors which secure the advertising face to the frame and must be manually released and detachable connectors which release a portion of the advertising face from the frame in response to winds above a threshold level. As a result of this arrangement, the inflatable billboard incurs only minimal damage even in high winds.

5 Claims, 6 Drawing Sheets

AIR INFLATED PORTABLE BILLBOARD

This application claims priority under 35 USC §119(e) to Provisional Patent Application Serial No. 60/272,068 filed on Mar. 1, 2001.

BACKGROUND OF THE INVENTION

In business, it is desirable to be able to communicate messages, advertisements or both in inexpensive ways that attract attention but are also flexible enough to allow for ready transportation of the sign to a near location and/or modification of the message being communicated.

The prior art teaches many devices which attempt to provide these benefits. For example, U.S. Pat. No. 4,372,071 teaches a fabric faced billboard comprising a sheet of fabric having the advertising message thereon pulled across a rigid billboard panel, wherein air is blown into the billboard, thereby causing the sheet of fabric to remain a smooth, continuous surface.

U.S. Pat. No. 4,369,591 teaches an inflatable display structure which uses an elongated inflated bag for its principal structural support. A display facing is releasably mounted directly onto the inflated bag by snaps or the like. The bag also includes a plurality of gussets within the bag, thereby providing a substantially flat surface for mounting the display facing thereto.

U.S. Pat. No. 4,776,121 teaches a self-contained inflatable sign which comprises a translucent envelope with a series of lights therein and a banner mounted onto the envelope.

U.S. Pat. No. 3,892,081 teaches an inflatable portable sign which comprises a support post and a balloon having printed matter thereon. In use, the post is inserted into the ground and the balloon is inflated.

U.S. Pat. No. 5,588,236 teaches a device for stretching a flexible sheet over a support frame for using the flexible sheet as a visual panel.

U.S. Pat. No. 4,881,916 teaches a two-piece display balloon holder.

U.S. Design Pat. No. 413,933 teaches an inflated, enclosed support to which a sign is mounted.

U.S. Design Pat. No. 337,129 teaches an inflated sign wherein the sign is enclosed within an envelope which is in turn inflated and sealed U.S. Design Pat. No. 334,031 teaches an inflatable sign which is effectively a flat balloon having indicia printed on a front face thereof.

U.S. Design Pat. No. 306,746 teaches a blimp-shaped sign onto which a banner or facing is directly attached.

However, these devices are subject to damage from even moderate winds. As will be apparent to one knowledgeable in the art, damage to the inflatable sign results in lost advertising time and therefore lost revenue. Clearly, an improved inflated sign which incurs minimal damage from moderate to high winds is needed.

SUMMARY OF THE INVENTION

According to the invention, there is provided an inflatable billboard comprising:

an inflatable frame having a top portion, a base portion and two sides, thereby defining an opening;

an advertising face mounted within the opening, releasable connectors mounting the advertising face to the inflatable frame, said releasable connectors being manually releasable; and detachable connectors mounting the advertising face to the inflatable frame, said detachable connectors releasing in response to wind pressure.

One embodiment of the invention will now be described in conjunction with the accompanying drawings in which:

BRIEF DESCRIPTION OF THE DRAWINGS

In the drawings like characters of reference indicate corresponding parts in the different figures.

DESCRIPTION OF THE PREFERRED EMBODIMENTS

Figure 1:
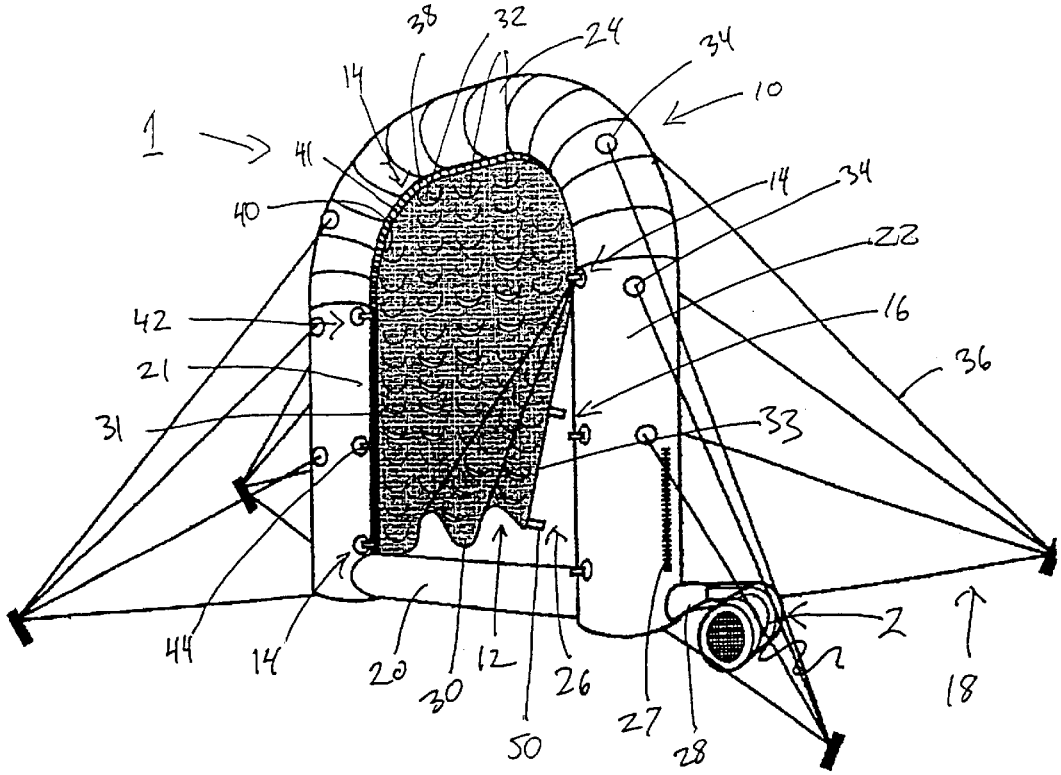
FIG. 1 is a side view in perspective of the inflatable sign in use with the wind pressure release means disengaged.

As used herein, "releasable" refers to connectors which must be manually released.

As used herein, "detachable" refers to connectors which release in response to wind pressure.

As discussed above, the problem with any outdoor cold air inflated billboard system is the effect of wind on that system. It is known from the outset that a billboard system of this nature will sustain damage in moderate to high winds. When dealing with winds of hurricane strength it is only possible to attempt to stop as much of the ripped apart system as possible from becoming airborne and causing damage to surrounding objects. In the case of a tornado obviously if trees can be uprooted so can a portable billboard system. Hurricanes and tornadoes occur rarely enough to have any significant effect on portable billboard systems in use. Moderate to high winds, however, do cause frequent damage to portable billboard systems. This damage results in advertising down time and lost revenues for everyone involved. While minor damage can be resolved on site by trained installers with little lost advertising time and therefore little lost revenue, major damage often involves removing the portable billboard system from the site for repair at substantial cost with possible loss of revenue for several days unless a replacement system is readily available.

Described herein is a device which incurs minimal damage from moderate to high winds, thereby reducing lost revenue. The device is designed so that the majority of the total surface area of the combined frame and advertising face is in the advertising face itself, as described below. The frame is designed with aerodynamic principles in mind with smooth curved surfaces. Similarly, the advertising face is also designed with aerodynamic principles in mind by cutting wind vents into its surface to allow wind to pass through in small but evenly distributed areas, as described below. Furthermore, the device includes a pressure release system which is arranged so that when the advertising face is hit with a gust of wind, the pressure release system causes the advertising face to break free of a portion of the frame, thereby relieving wind pressure on approximately ⅓ of its surface area. The advertising face blows in the wind until a trained installer can respond to the situation by quickly reattaching the pressure release system. It is of note that the advertising face would only be reattached when it is judged that the winds will remain at a lower level for a significant amount of time. As will be appreciated by one knowledgeable in the art, the above scenario could have resulted in major damage to the air inflated portable billboard system if the advertising face had remained completely fastened to the frame and permitted to act as a sail in the wind.

As discussed herein, the device comprises a cold air inflated fabric structural frame which supports a large flat interchangeable fabric surface upon which graphics are applied thereby creating a lightweight inflated portable billboard system with an advertising face. The structural frame is a simple tubular structure which eliminates the need for interior baffles or gussets. The tubular structure curves smoothly around corners as much as possible to eliminate stress points and to provide a continuous rigid frame. The air inflated horizontal tubes supported above the ground cannot span long distances without resulting in deflection of the tube causing structural weakness and poor aesthetics. The smooth gently curving structures of the structural frame contribute to positive aerodynamic performance. Constructing the structural frame in this manner provides a large advertising surface with a proportionally lower amount of fabric, making the system as light as possible.

Referring to the drawings, an inflatable billboard 1 comprises a frame 10, an advertising face 12, releasable mounting means 14, detachable mounting means 16 and tethering means 18.

Figure 5:
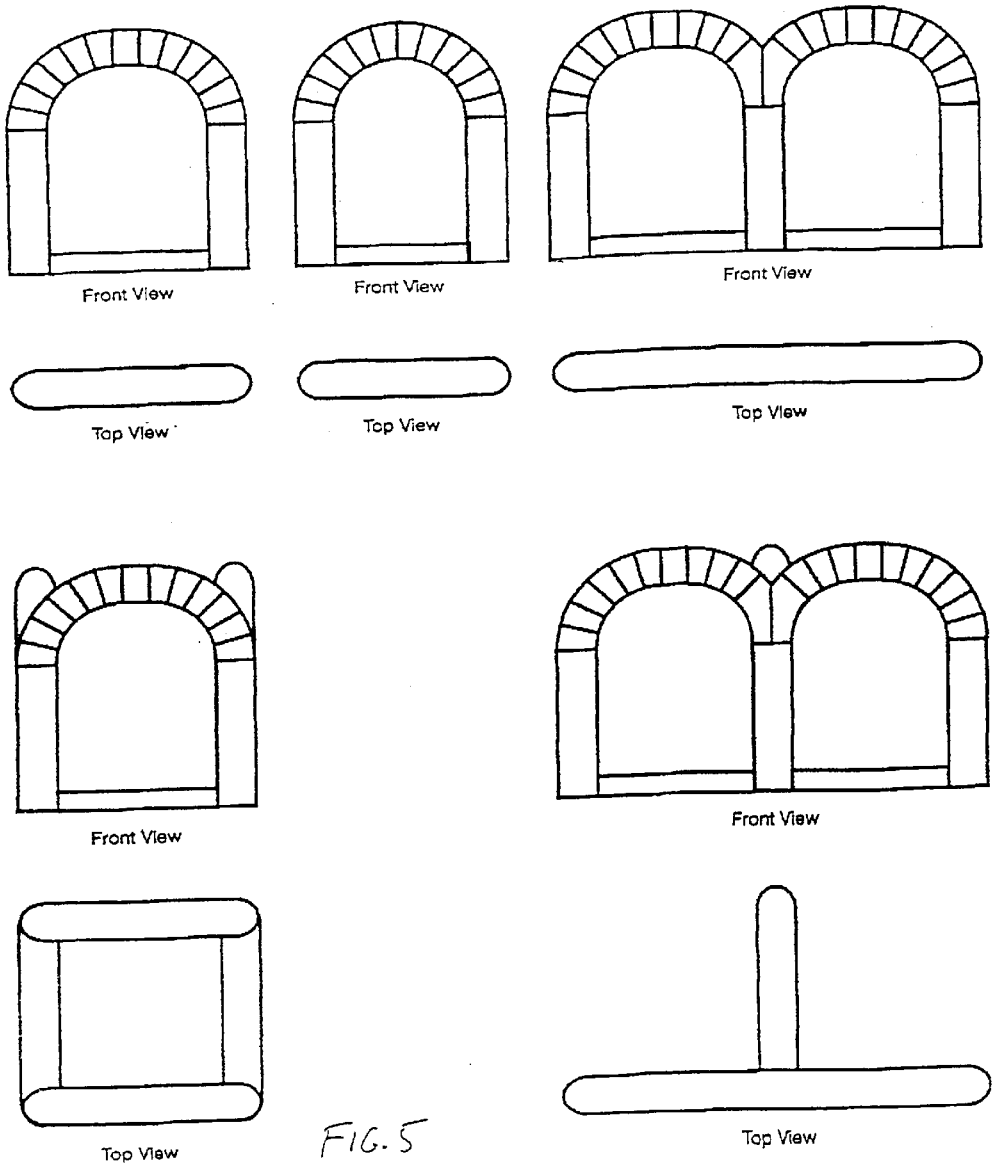
FIG. 5 shows some alternate configurations of the inflatable sign.

As shown in FIG. 1, the frame 10 has a base 20, a first side 21, a second side 22 and an arched top 24 defining an opening 26 for mounting the advertising face 12 therein, as described below. As can be seen in FIGS. 1 and 5, in this embodiment, the base 20, the first side 21, the second side 22 and the arched top 24 are substantially tubular in shape, having smooth corners. As a result of this arrangement, stress points are eliminated and the frame 10 is a continuous, rigid frame. The frame 10 also includes a deflation zipper 27 for deflating the inflatable billboard and an adapter sleeve 28 for inflating the inflatable billboard 1 by connecting a blower 2 thereto, as described below. The frame also includes the releasable mounting means 14, the detachable mounting means 16 and the tethering means 18, as described below.

The advertising frame 12 comprises a substantially flat sheet 30 having a first side 31 and a second side 33. The sheet 30 includes printed matter and/or graphics on at least one face thereof. Specifically, the sheet 30 is arranged such that graphics and the like are printed directly onto the sheet 30. The advertising face 12 further includes a plurality of wind vents 32 extending through the sheet 30. Specifically, the vents 32 allow wind to pass through in small but evenly distributed areas, as shown in FIG. 1. The advertising face 12 also includes releasable mounting means 14 and detachable mounting means 16, as described below.

In some embodiments, the advertising face 12 is made of a vinyl material, a vinyl coated nylon material or other suitable material. It is of note that these materials accept regular printing inks and digital imaging inks. The graphics are applied to the advertising face using means known in the art, for example, direct digital imaging, screen printing, painting or airbrushing.

The tethering means 18 anchors the inflatable billboard 1 to a support surface. In one embodiment, shown in FIG. 1, the tethering means 18 comprises a plurality of D-rings 34 sewn onto the outer surface of the frame 10. As can be seen in FIG. 1, in this embodiment, the D-rings 34 are distributed at various positions on the front and back of the frame 10 for stabilizing the inflatable billboard 1, as described below. In use, straps 36 connect the D-rings 34 to eyebolts mounted on the support surface, as described below.

Figure 2:
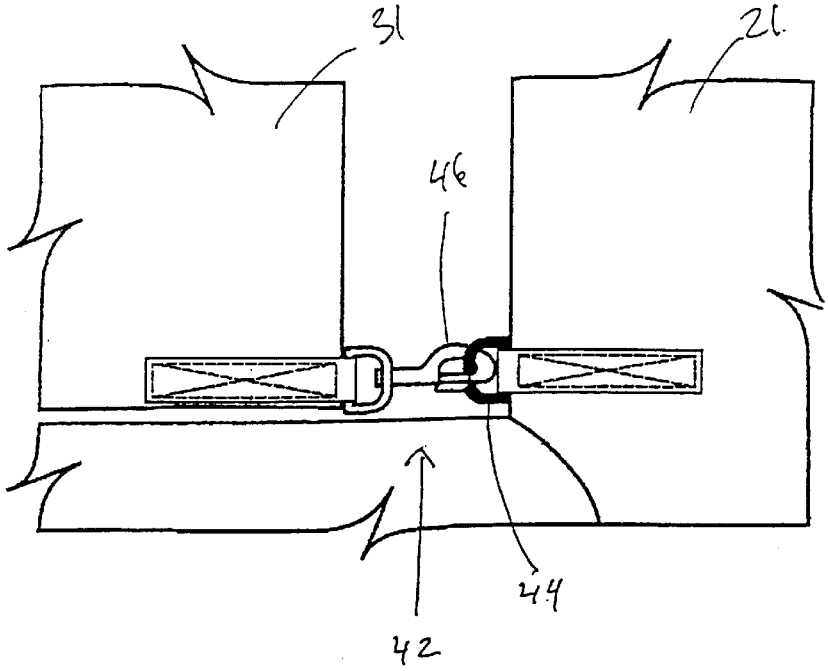
FIG. 2 shows the release strap.
Figure 3:
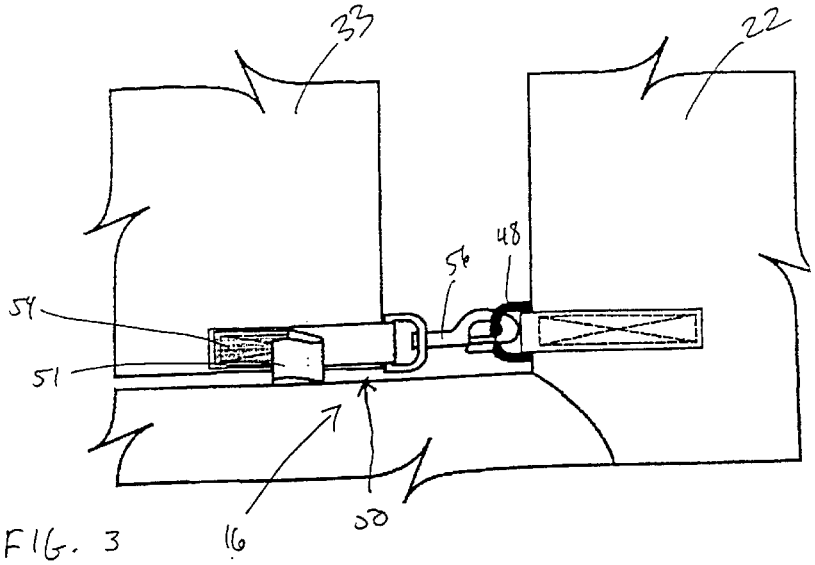
FIG. 3 shows the wind pressure release strap in the closed position.
Figure 4:
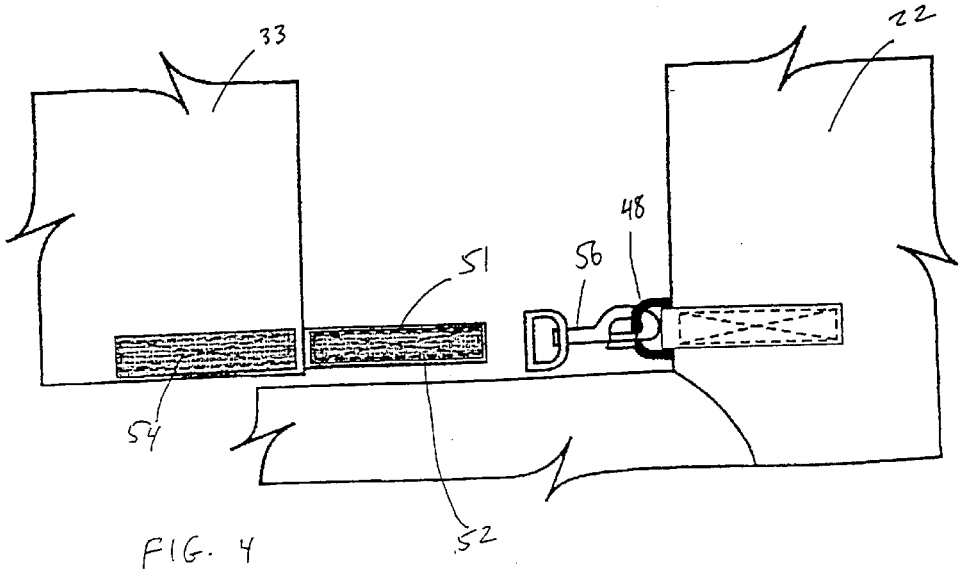
FIG. 4 shows the wind pressure release strap in the open position.

The releasable mounting means 14 connects the advertising frame 12 to the frame 10. Specifically, the releasable mounting means 14 secure the advertising frame 12 within the opening 26 of the frame 10 such that the advertising frame 12 and the frame 10 are not separated during even strong winds but are releasable so that the advertising face 12 can be replaced. In this embodiment, the releasable mounting means 14 include a first zipper 38 on the arched top 24 of the frame 10 and a second zipper 40 on the sheet 30. Connecting first zipper 38 to second zipper 40 forms sealing zipper 41 which reversibly secures the frame 10 and the advertising face 12 together, as described below. The releasable mounting means 14 also includes release straps 42. Specifically, in one embodiment, the release strap 42, shown in FIG. 2, comprises D-rings 44 stitched to or otherwise mounted onto the first side 21 and the second side 22 of the frame 10 and corresponding hooks 46 stitched onto the first side 31 and second side 33 of the sheet 30. For use, the hooks 46 are fitted onto the respective D-rings 44, thereby securing the advertising face 12 to the frame 10, as described below.

The detachable mounting means 16 detachably mounts the advertising face 12 to the frame 10 such that winds above a threshold level cause the advertising face 12 to partially release from the frame 10, thereby reducing wind-associated strain on the inflatable billboard 1 and minimizing damage therefrom. In one embodiment, the detachable mounting means 16 comprises straps 50 made of fabric, for example, nylon webbing, which is sewn permanently onto the back of the advertising face 12, adjacent to the second side 33 of the sheet 30. A portion 51 of the strap 50 extends beyond the advertising face 12 and has hook fastening tape 52 permanently stitched to it. The extended portion of the strap 50 is passed through the retaining loop of a snap hook 56, which is manually hooked onto D-ring 48 on the second side 22 of the frame 10. The strap 50 then folds back onto the front surface of the advertising face 12 onto a piece of loop fastening tape 54 and thus is held in place in a non-permanent fashion.

Figure 7:
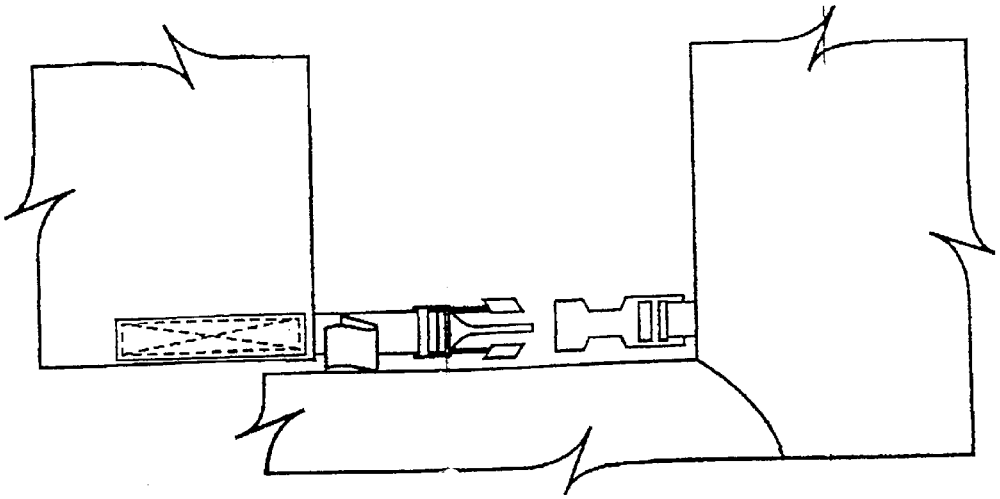
FIG. 7 shows an alternate wind pressure release strap in the open position

In alternative embodiments, the advertising face 12 is mounted to the frame 10 by a bungee cord system, a spring system, a mechanical spring release system or by a male-female connector, as shown in FIG. 7. As will be apparent to one of skill in the art, these connectors may be used as either releasable mounting means 14 and/or as detachable mounting means.

Figure 6:
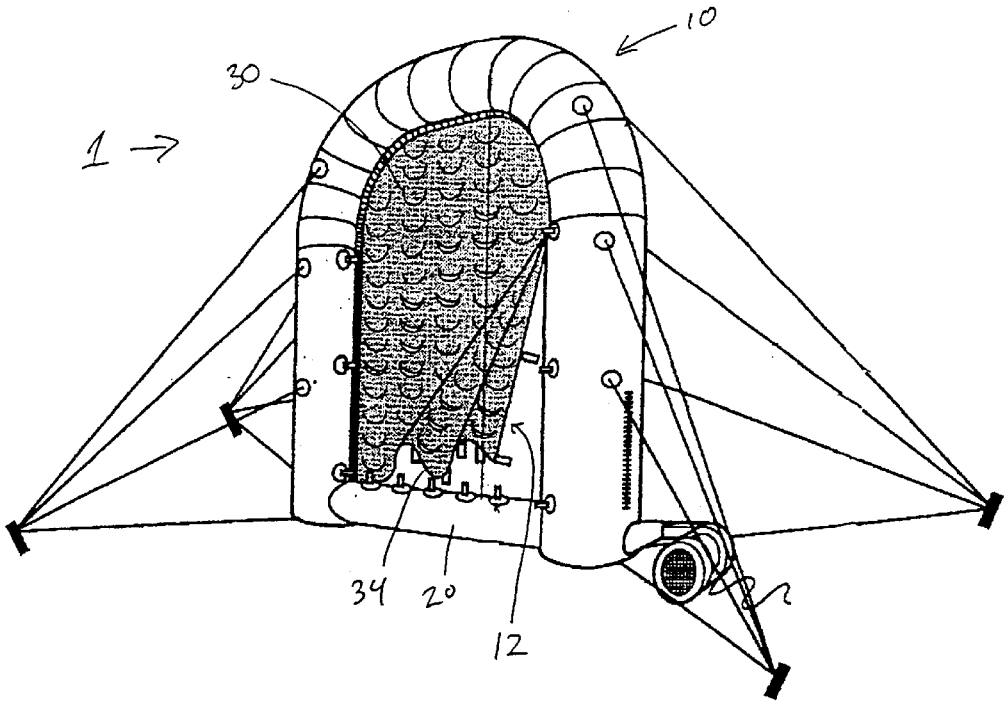
FIG. 6 shows a side view in perspective of an alternative embodiment of the inflatable sign.

In an alternative embodiment shown in FIG. 6, the base 20 and a third side 34 of the flat sheet 30 includes either releasable mounting means 14 or detachable mounting means 16.

For use, the inflatable billboard 1 is assembled and inflated on a rooftop or on the ground. The frame 10 is laid out in the intended display area and is secured by connecting D-rings 34 to corresponding eyebolt screws or the like mounted on either a ground stake or the fascia of a building with the straps 36, as shown in FIG. 1. The advertising face 12 is then aligned with the opening 26 of the frame 10. The advertising face 12 is mounted to the frame 10 by positioning the advertising face 12 such that first zipper 38 on the frame 10 and second zipper 40 on the sheet 30 combine to form sealing zipper 41. As will be apparent to one knowledgeable in the art, the sealing zipper 41 provides near permanent fastening of the advertising face 12 to the frame 10 and provides stable hanging support over the full width of the sheet 30 as shown in FIG. 1. Next, each one of the hooks 46 are engaged with the corresponding D-ring 44. As discussed above, the hooks are stitched onto the first side 31 and the second side 33 of the sheet 30. Next, the detachable mounting means 16 are connected by passing the port hook fastening tape 52 through the retaining loop of the snap hook 56 and folding the strap 50 back onto the loop fastening tape 54. The hook 56 is then hooked onto D-ring 48 on the second side 22 of the frame 10. The blower 2 is then connected to the adapter sleeve 28 and the inflatable billboard 1 is inflated. The cold air blower 2 is powered by a 110 Volt circuit is attached with hook and loop fastening tape to the fabric frame. The cold air blower is turned on and left on to inflate the fabric frame, which will then support the advertising face in a taut manner. The frame 10 is then plumbed and/or levelled as required. Lighting may then be optionally installed as required.

As discussed above, the advertising face 12 is mounted to the frame 10 using the sealing zipper 41 to ensure near permanent fastening of the advertising face to the frame and a stable hanging support over the full width of the advertising face 12. As discussed above, the remaining edges of the advertising face, sides and bottom, are held in place by hook fastening tape on the advertising face and loop fastening tape on the cold air inflated fabric structural frame. In the embodiment shown in FIG. 1, at four points the advertising face is near permanently fastened to the fabric frame with a manual release snap hook sewn permanently to the advertising face with an anchor strap, hooked to a 'd' ring on the fabric frame. At two points the advertising face is fastened with a detachable wind pressure release strap, as discussed above.

In other embodiments, the inflatable billboard 1 may be arranged such that the four lower attachment points (two on either side) are mounted with the wind pressure release straps. In these embodiments, the top of the advertising face 12 is still held by the sealing zipper 41, leaving the bottom portion of the advertising face 12 (in some embodiments, approximately ⅔ of the area) to detach as a result of a gust of wind. In some embodiments, these four detachable wind pressure release straps could be engineered to detach at four different peak load levels to provide a more controlled system. As will be appreciated by one knowledgeable in the art, this could be done in any embodiment of the inflatable billboard 1 having two or more detachable wind pressure release straps. For example, one bottom corner may detach first, followed by the opposite bottom corner, followed by the next adjacent point and so on. Each succeeding release would require a larger gust of wind. In this manner, control over release would be maximized while damage to the inflatable billboard 1 would still be minimized.

In use, the inflatable billboard 1 provides a highly visible means of communicating an advertisement or an announcement to the public. When the inflatable billboard 1 encounters light to moderate winds, the wind contacts the advertising face 12 and passes through the vents 32. As wind strength increases, wind load on the advertising face places the hook fastening tape 52 and the loop fastening tape 54 interface of the detachable mounting means 16 in shear tension. When the wind load reaches a critical value, the fastening tapes 52, 54 shear from each other allowing the wind to push the advertising face aside and hence relieving the pressure on the advertising face.

In one embodiment, the inflatable billboard is an arch shaped structure 18 feet wide×20 feet tall×3 feet deep and supports a graphic area that is 12 feet wide×15 feet tall. The fabric frame is made of 210 denier nylon coated both sides with poly vinyl chloride. Other suitable arrangements are shown in FIG. 5.

The system is a lightweight portable billboard with wind pressure release system, which can be handled and installed by one person. The flat graphic area makes application of extremely high quality graphics possible.

The idea fulfills the need for businesses to communicate a message, an advertisement or both in a temporary, easily changeable and readily transportable manner. The air inflated portable billboard with wind pressure release system allows businesses to respond immediately to their on site communication requirements whether it be retail promotion, emergency signage or event support and signage with more confidence in the reliability of the system.

Possible variations include use of external or internal lighting systems and application of graphics directly to the fabric frame itself. Different designs could be developed using the same tubular fabric structural frame with no interior baffles required.

In another embodiment, the inflatable billboard 1 as described above is modified for indoor use, for example, at tradeshows, in showrooms and the like. Because interior systems are not subject to wind, in these embodiments, the base of the frame is omitted, there are no tethering points, no detachable points and no external fan. In some embodiments, the indoor billboard is 10 feet wide, nine feet tall and has a two foot depth. The unit is weighted at the bottom of the two columns with a wood or other suitable base and internal sand bags or similar ballast is used to anchor the indoor billboard. The advertising face is held in place with two zippers started at the top center of the arch and continued to the ground. The indoor billboard also includes an internal fan powered by a 110 volt circuit.

While the preferred embodiments of the invention have been described above, it will be recognized and understood that various modifications may be made therein, and the appended claims are intended to cover all such modifications which may fall within the spirit and scope of the invention.

What is claimed is:

1. An inflatable billboard comprising:

an inflatable frame having a top portion, a base portion and sides defining an opening therebetween; and an advertising face mounted within the opening, said advertising face being mounted to the frame by two types of connectors:

manual release connectors being arranged so as to secure a portion of the advertising face to the frame such that the advertising face and the frame are not separated, said manual release connectors being manually releasable for replacing the advertising face and being substantially permanently connected to the advertising face; and wind release connectors being arranged so that winds above a threshold level cause a portion of the advertising face to release from the frame, said connectors being different such that in response to winds above said threshold level, the portion of the advertising face secured to the frame by the manual release connectors remains connected to the frame while the portion of the advertising face connected to the frame by the wind release connectors is released from the frame by the wind release connectors, thereby reducing wind-associated strain on the inflatable billboard by reducing surface area of the inflatable billboard.

2. The inflatable billboard according to claim 1 wherein the advertising face is a flat sheet.

3. The inflatable billboard according to claim 2 wherein the sheet is vented.

4. The inflatable billboard according to claim 1 including deflation means.

5. The inflatable billboard according to claim 4 wherein the deflation means is a zipper.

* * * * *